US011824302B2

(12) United States Patent
Li et al.

(10) Patent No.: US 11,824,302 B2
(45) Date of Patent: Nov. 21, 2023

(54) ELECTRICAL CONNECTOR WITH IMPROVED ASSEMBLY EFFICIENCY

(71) Applicant: LUXSHARE PRECISION INDUSTRY CO., LTD., Shenzhen (CN)

(72) Inventors: Huabing Li, Shenzhen (CN); Zhongyuan Lai, Shenzhen (CN); Yu Huang, Shenzhen (CN); Zhexian Tianzhou, Shenzhen (CN)

(73) Assignee: Luxshare Precision Industry Co., Ltd., Shenzhen (CN)

( * ) Notice: Subject to any disclaimer, the term of this patent is extended or adjusted under 35 U.S.C. 154(b) by 76 days.

(21) Appl. No.: 17/554,319

(22) Filed: Dec. 17, 2021

(65) Prior Publication Data

US 2022/0247121 A1 Aug. 4, 2022

(30) Foreign Application Priority Data

Jan. 29, 2021 (CN) ..... 202120274726.X

(51) Int. Cl.

| | |
|---|---|
| ***H01R 13/58*** | (2006.01) |
| ***H01R 13/516*** | (2006.01) |
| ***H01R 13/502*** | (2006.01) |
| ***H01R 24/60*** | (2011.01) |

(52) U.S. Cl.

CPC ..... *H01R 13/5816* (2013.01); *H01R 13/502* (2013.01); *H01R 13/516* (2013.01); *H01R 24/60* (2013.01)

(58) Field of Classification Search

CPC ..... H01R 13/5219; B29C 45/14786; B29C 45/16; B29K 2313/00

USPC ..... 439/271

See application file for complete search history.

(56) References Cited

U.S. PATENT DOCUMENTS

| | | | | |
|---|---|---|---|---|
| 9,520,673 | B2 * | 12/2016 | Xing | B29C 70/84 |
| 9,525,223 | B2 * | 12/2016 | Little | H01R 13/6658 |
| 9,583,889 | B2 * | 2/2017 | Wu | H01R 13/6593 |
| 9,590,363 | B2 * | 3/2017 | Wu | H01R 13/6585 |
| 9,728,885 | B2 * | 8/2017 | Yokoyama | H01R 24/60 |
| 9,768,568 | B1 * | 9/2017 | Jin | H01R 24/60 |
| 9,780,495 | B2 * | 10/2017 | Wu | H01R 12/53 |
| 9,966,710 | B2 * | 5/2018 | Chen | H01R 13/502 |
| 9,979,145 | B2 * | 5/2018 | Wu | H01R 13/6591 |
| 10,333,263 | B2 * | 6/2019 | Wu | H01R 24/64 |
| 2015/0288107 | A1 * | 10/2015 | Wu | H01R 13/6593 439/357 |
| 2016/0079689 | A1 * | 3/2016 | Wu | B23K 26/32 228/180.21 |
| 2016/0285208 | A1 * | 9/2016 | Wu | H01R 13/6581 |

(Continued)

*Primary Examiner* — Alexander Gilman

(74) *Attorney, Agent, or Firm* — Birch, Stewart, Kolasch & Birch, LLP

(57) ABSTRACT

An electrical connector includes a connector body and an outer metal shell. The connector body includes an insulating body, a conductive terminal fixed to the insulating body, and an inner metal shell at least partly covering the insulating body. The outer metal shell at least partially covers the inner metal shell. The outer metal shell includes a first metal shell and a second metal shell assembled together. The first metal shell includes a first buckle portion. The second metal shell includes a second buckle portion buckled with the first buckle portion. As a result, assembly efficiency of the electrical connector is improved.

18 Claims, 14 Drawing Sheets

(56) References Cited

U.S. PATENT DOCUMENTS

| | | | | |
|---|---|---|---|---|
| 2016/0322761 | A1* | 11/2016 | Wu | H01R 13/7175 |
| 2017/0149183 | A1* | 5/2017 | Gou | H01R 12/716 |
| 2017/0310054 | A1* | 10/2017 | Yu | H01R 13/652 |
| 2018/0040969 | A1* | 2/2018 | Wu | H01R 12/596 |
| 2018/0048078 | A1* | 2/2018 | Wang | H01R 13/629 |
| 2018/0115122 | A1* | 4/2018 | Xing | H01R 13/7172 |
| 2018/0166797 | A1* | 6/2018 | Ju | H01R 4/023 |
| 2018/0166825 | A1* | 6/2018 | Ju | H01R 13/6581 |
| 2018/0375232 | A1* | 12/2018 | Wu | H01R 13/6593 |
| 2019/0020157 | A1* | 1/2019 | Wu | H01R 9/0515 |
| 2019/0221953 | A1* | 7/2019 | Chen | H01R 13/516 |
| 2019/0267761 | A1* | 8/2019 | Wu | H01R 12/722 |
| 2021/0159644 | A1* | 5/2021 | Evans | H01R 13/6477 |

* cited by examiner

ELECTRICAL CONNECTOR WITH IMPROVED ASSEMBLY EFFICIENCY

CROSS-REFERENCE TO RELATED APPLICATION

This patent application claims priority of a Chinese Patent Application No. 202120274726.X, filed on Jan. 29, 2021 and titled "ELECTRICAL CONNECTOR", the entire content of which is incorporated herein by reference.

TECHNICAL FIELD

The present disclosure relates to an electrical connector, which belongs to a technical field of connectors.

BACKGROUND

Some electrical connectors in the relevant art include an insulating body, a plurality of conductive terminals fixed to the insulating body, an inner metal shell sleeved on the insulating body, and an outer metal shell sleeved on the inner metal shell. In general, the outer metal shell is a one-piece structure which is fixed to the inner metal shell by soldering or welding in order to achieve better shielding effect.

However, such a one-piece outer metal shell is usually assembled on the inner metal shell along a direction parallel to a mating direction during assembling, and the assembly efficiency is low. Besides, the outer metal shell and the inner metal shell are fixed by soldering or welding, which reduces production efficiency. In addition, soldering or welding slag will inevitably be generated during soldering or welding. When the soldering or welding slag falls into the inside of the electrical connector, it is easy to cause a short circuit of the conductive terminals.

SUMMARY

An object of the present disclosure is to provide an electrical connector with higher assembly efficiency.

In order to achieve the above object, the present disclosure adopts the following technical solution: an electrical connector, including: a connector body, the connector body including an insulating body, a conductive terminal fixed to the insulating body, and an inner metal shell at least partially covering the insulating body; and an outer metal shell, the outer metal shell at least partially covering the inner metal shell; wherein the outer metal shell includes a first metal shell and a second metal shell, the first metal shell and the second metal shell are assembled with each other, the first metal shell includes a first buckle portion, the second metal shell includes a second buckle portion which is buckled with the first buckle portion; and wherein the first metal shell and/or the second metal shell include a first engaging portion, and the connector body includes a second engaging portion which is engaged with the first engaging portion.

In order to achieve the above object, the present disclosure adopts the following technical solution: an electrical connector, including: a connector body, the connector body including an insulating body, a plurality of conductive terminals fixed to the insulating body, and an inner metal shell at least partially enclosing the insulating body along a mating direction of the electrical connector; a cable, the conductive terminals are electrically connected to the cable; and an outer metal shell, the outer metal shell at least partially enclosing the inner metal shell; wherein the outer metal shell includes a first metal shell and a second metal shell, the first metal shell and the second metal shell are assembled with each other along a width direction of the electrical connector perpendicular to the mating direction of the electrical connector, the first metal shell includes a first buckle portion, the second metal shell includes a second buckle portion which is locked with the first buckle portion; and wherein the first metal shell and/or the second metal shell include a first engaging portion, and the connector body includes a second engaging portion which is engaged with the first engaging portion.

Compared with the prior art, the outer metal shell of the electrical connector of the present disclosure is a split type, and includes a first metal shell and a second metal shell which are assembled together. As a result, it reduces the manufacturing difficulty and improves the assembling efficiency of the electrical connector.

DETAILED DESCRIPTION

Figure 1:
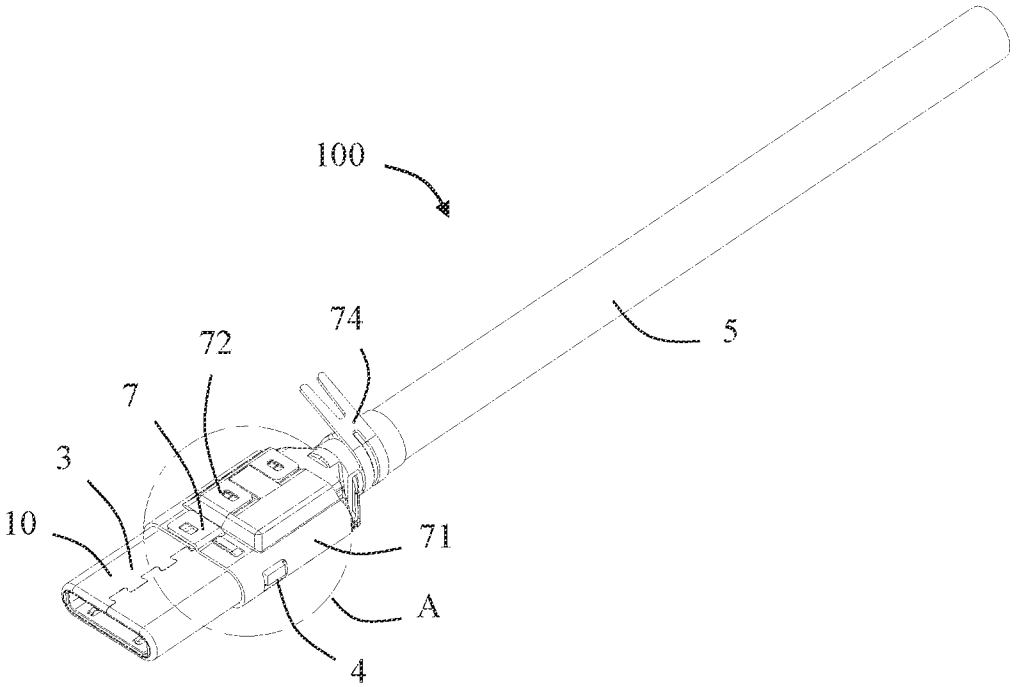
FIG. 1 is a perspective schematic view of an electrical connector in an accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 4, 13 and 14, an illustrated embodiment of the present disclosure discloses an electrical connector 100. The electrical connector 100 includes a connector body 10, a built-in circuit board 4, a cable 5 electrically connected to the built-in circuit board 4, an insulating housing 6, and an outer metal shell 7 at least partially covering the connector body 10.

Figure 13:
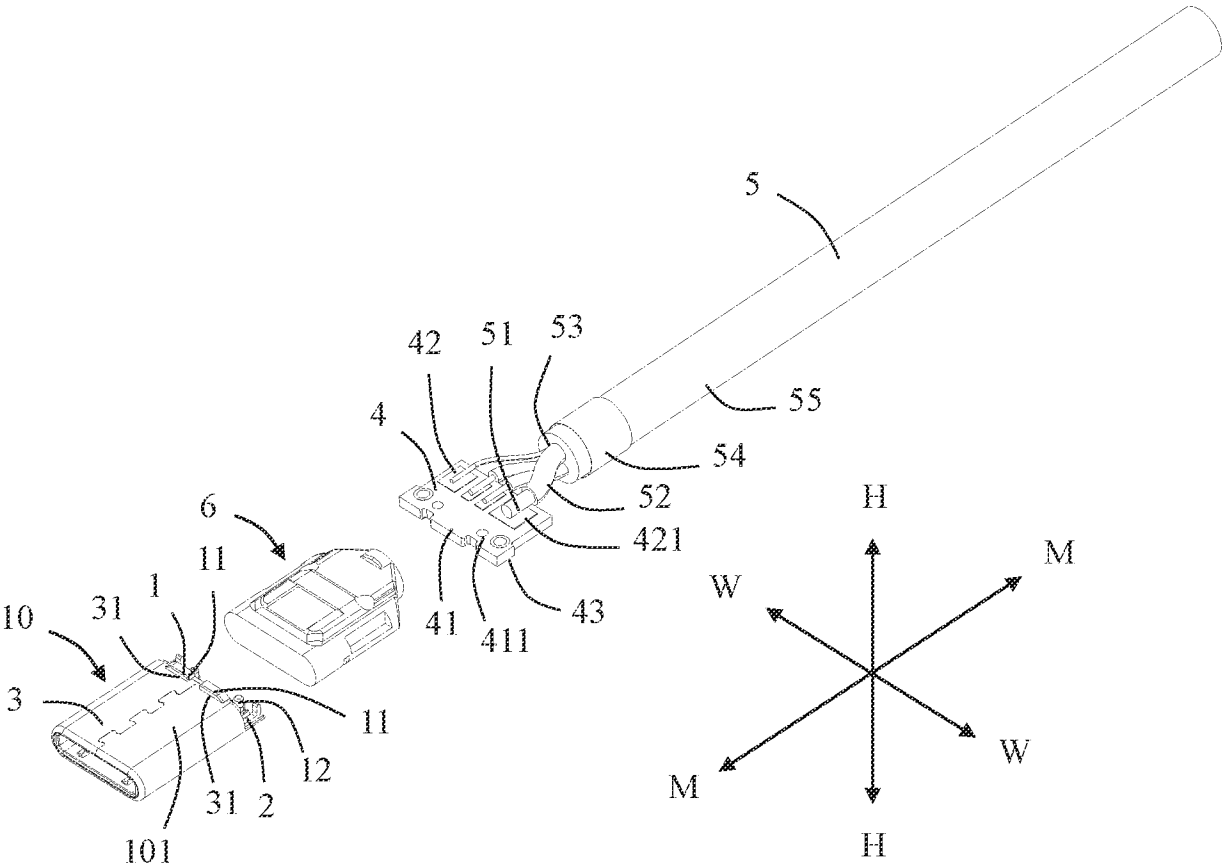
FIG. 13 is a partially exploded perspective view after removing the first metal shell and the second metal shell in FIG. 9.
Figure 14:
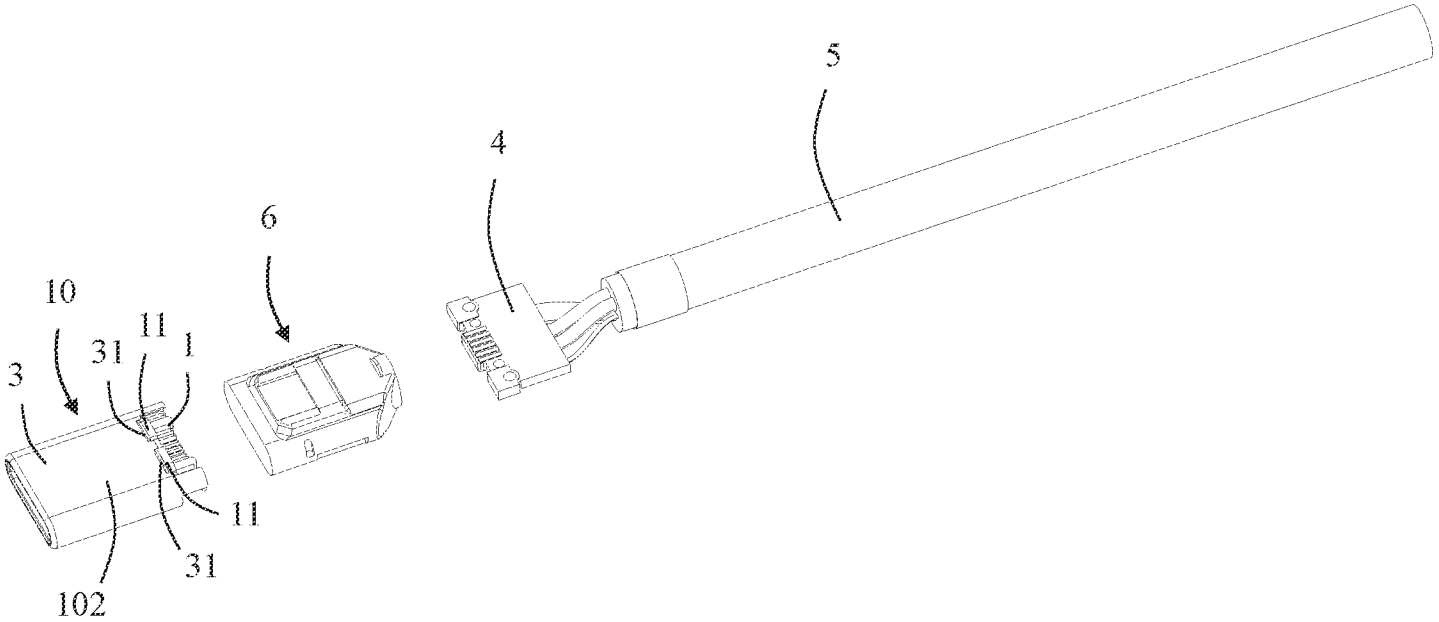
FIG. 14 is a partially exploded perspective view of FIG. 13 from another angle.

Referring to FIGS. 13 and 14, in the illustrated embodiment of the present disclosure, the connector body 10 includes an insulating body 1, a plurality of conductive terminals 2 fixed to the insulating body 1, and an inner metal shell 3 at least partially covering the insulating body 1. In an embodiment of the present disclosure, the connector body 10 includes a USB Type C connector port. Of course, in other embodiments, the connector body 10 may also include other types of connector ports, which are not limited in the present disclosure. The connector body 10 is adapted to mate with a mating connector (not shown) along a mating direction M-M of the electrical connector 100 so as to achieve data transmission. In the illustrated embodiment of the present disclosure, the mating direction M-M is a front-rear direction.

In the illustrated embodiment of the present disclosure, the plurality of conductive terminals 2 are insert-molded with the insulating body 1. Of course, in other embodiments, the conductive terminals 2 may also be fixed to the insulating body 1 by assembling. The connector body 10 includes a first surface 101 (for example, an upper surface) and a second surface 102 (for example, a lower surface) which are disposed oppositely along a height direction H-H of the electrical connector 100.

Figure 2:
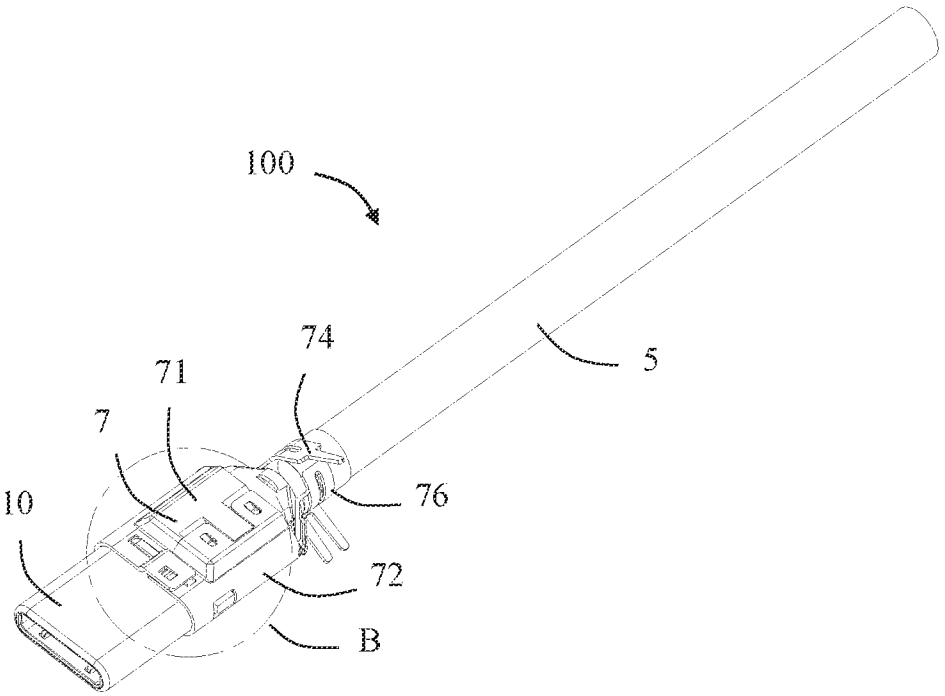
FIG. 2 is a perspective schematic view of FIG. 1 from another angle.

As shown in FIGS. 1 and 2, the outer metal shell 7 includes a first metal shell 71 and a second metal shell 72. The first metal shell 71 and the second metal shell 72 are assembled together. In some embodiments, the first metal shell 71 includes a first buckle portion. The second metal shell 72 includes a second buckle portion which is buckled with the first buckle portion. The first metal shell 71 and the second metal shell 72 are assembled with each other to form the outer metal shell 7 via the first buckle portion being buckled with the second buckle portion. The first metal shell 71 and/or the second metal shell 72 are further provided with a first engaging portion. The connector body 10 is provided with a second engaging portion which is engaged with the first engaging portion. The outer metal shell 7 and the connector body 10 are fixed to each other via the first engaging portion being engaged with the second engaging portion.

In some embodiments, the first engaging portion is provided on one of the first metal shell 71 and the second metal shell 72. In some embodiments, there are at least two first engaging portions which are provided on the first metal shell 71 and the second metal shell 72, respectively.

As shown in FIGS. 3, 4, 9 and 10, the second engaging portion includes a first protrusion 31 provided on the inner metal shell 3 and a second protrusion 11 provided on the insulating body 1. The first engaging portion includes a buckle groove for locking with the first protrusion 31 and the second protrusion 11. The first engaging portion and the second engaging portion are engaged and fixed with each other via the first protrusion 31 and the second protrusion 11 being locked with the buckle groove (details will be described later). In some embodiments, the first engaging portion and the second engaging portion are engaged and fixed to each other by a tight fit.

In some embodiments, at least two second engaging portions are provided, in which one of the second engaging portions is exposed to the first surface 101, and another one of the second engaging portions is exposed to the second surface 102. At least two first engaging portions are provided and correspond to the first surface 101 and the second surface 102, respectively.

In some embodiments, four second engaging portions are provided, in which two of the four second engaging portions are disposed on the first surface 101, and another two of the four second engaging portions are disposed on the second surface 102. Four first engaging portions are provided, in which two of the four first engaging portions are provided on the first metal shell 71 and correspond to the first surface 101 and the second surface 102, respectively; and another two of the four first engaging portions are provided on the second metal shell 72 and correspond to the first surface 101 and the second surface 102, respectively.

In the illustrated embodiment of the present disclosure, the inner metal shell 3 is stamped from a metal sheet. The inner metal shell 3 has a substantially hollow cylindrical shape so as to be able to receive the insulating body 1 along the mating direction M-M. The inner metal shell 3 encloses the insulating body 1. The inner metal shell 3 further includes a plurality of first protrusions 31 protruding upwardly from the first surface 101 and protruding downwardly from the second surface 102. In the illustrated embodiment of the present disclosure, each first protrusion 31 is a flange formed on a rear edge of the inner metal shell 3. In the illustrated embodiment of the present disclosure, two first protrusions 31 are provided protruding upwardly from the first surface 101, and the two first protrusions 31 are disposed at intervals along a width direction W-W of the electrical connector 100. Two first protrusions 31 are provided protruding downwardly from the second surface 102, and the two first protrusions 31 are disposed at intervals along the width direction W-W of the electrical connector 100. Preferably, the two first protrusions 31 located on an upper side and the two first protrusions 31 located on a lower side are respectively aligned and disposed along the height direction H-H of the electrical connector 100.

Figure 3:
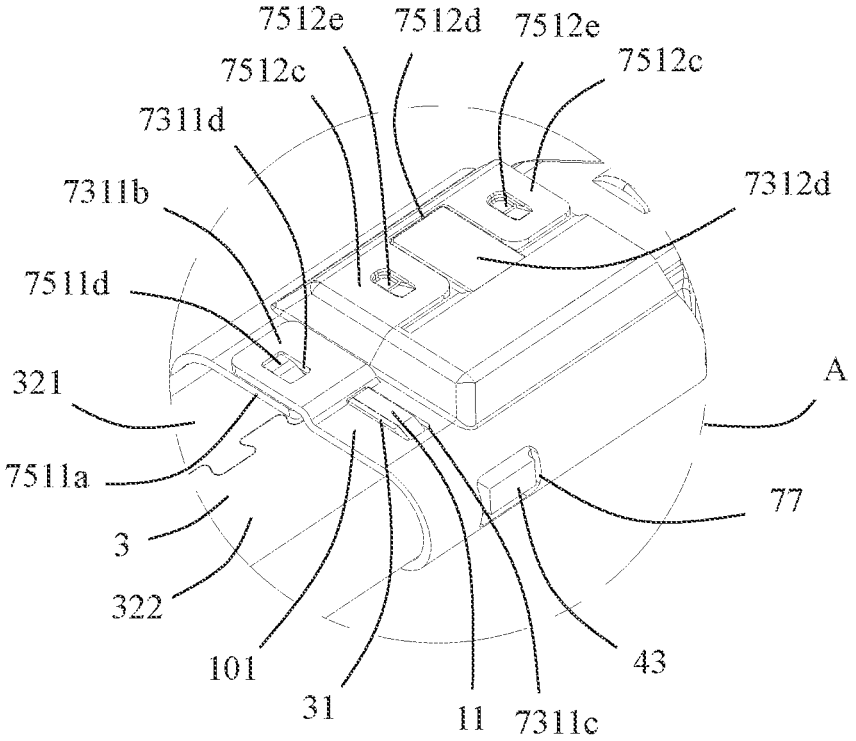
FIG. 3 is a partial enlarged view of a circled portion A in FIG. 1.
Figure 3:
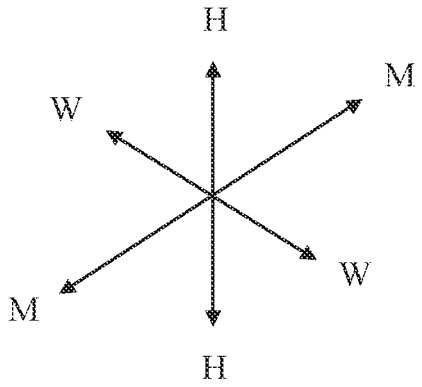
Figure 4:
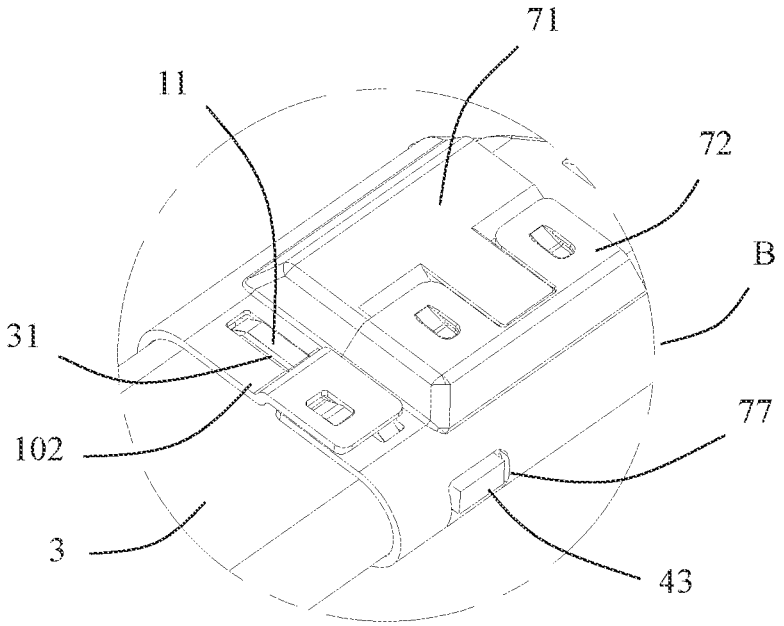
FIG. 4 is a partial enlarged view of a circled portion B in FIG. 2.
Figure 5:
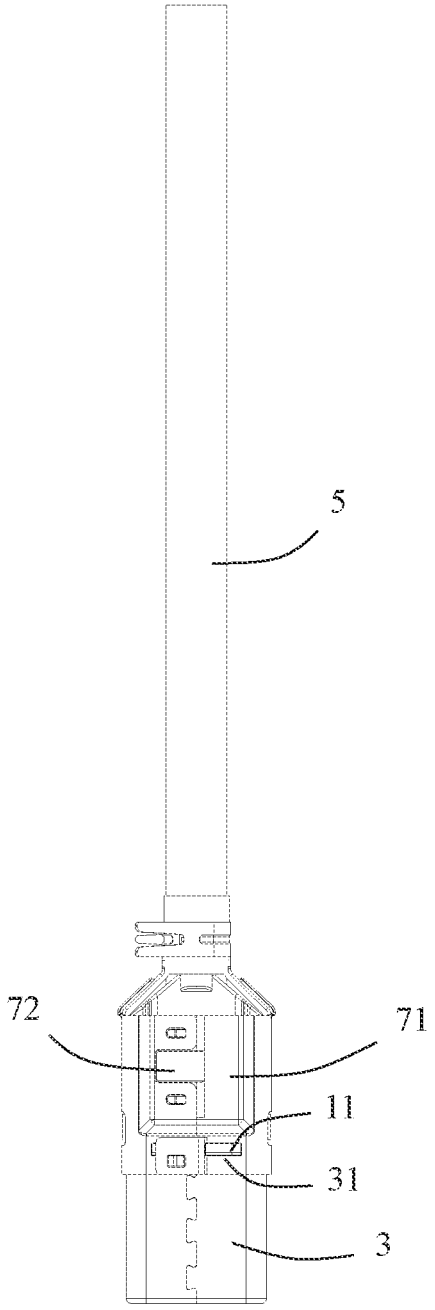
FIG. 5 is a top view of FIG. 1.
Figure 6:
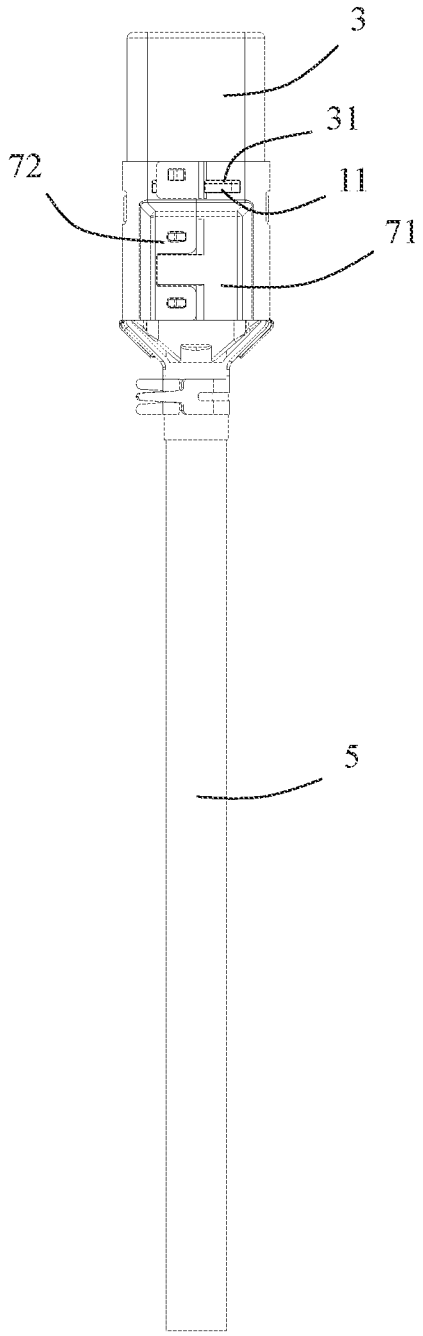
FIG. 6 is a bottom view of FIG. 1.
Figure 7:
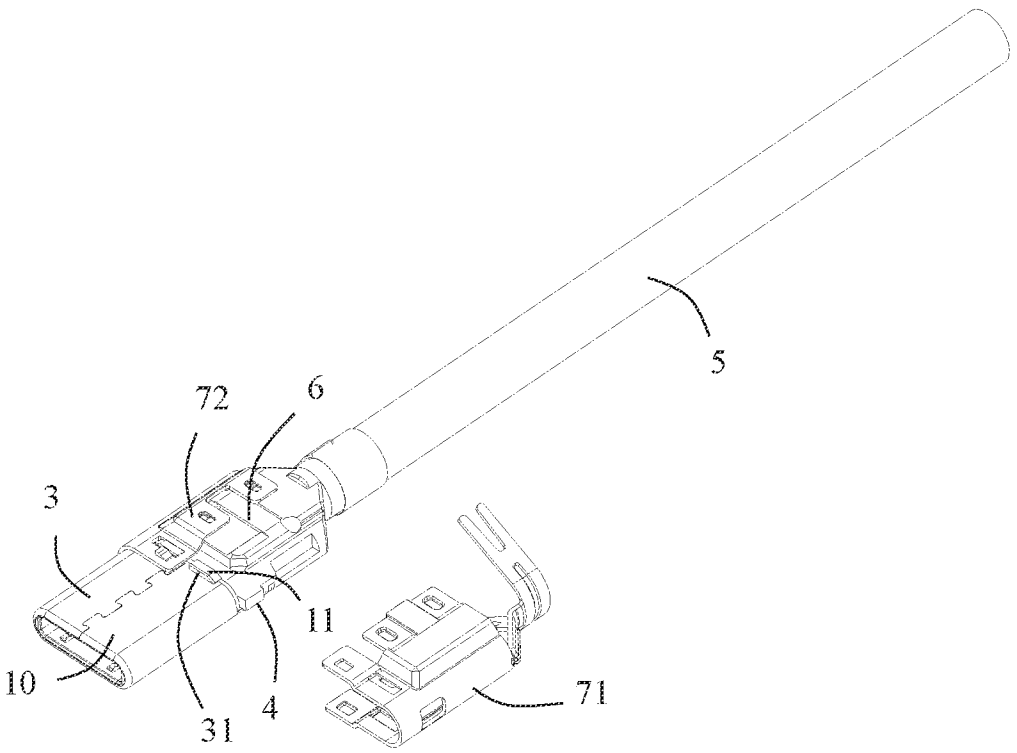
FIG. 7 is a partially exploded perspective view of FIG. 1, in which a first metal shell is separated.
Figure 8:
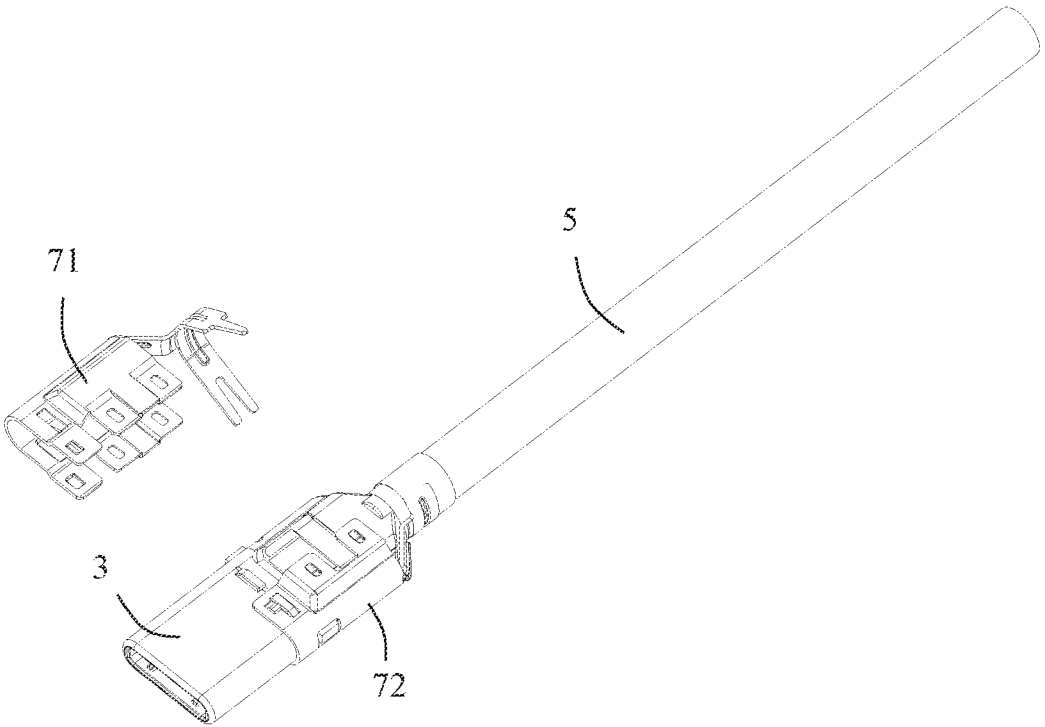
FIG. 8 is a partial perspective exploded view of FIG. 7 from another angle.
Figure 9:
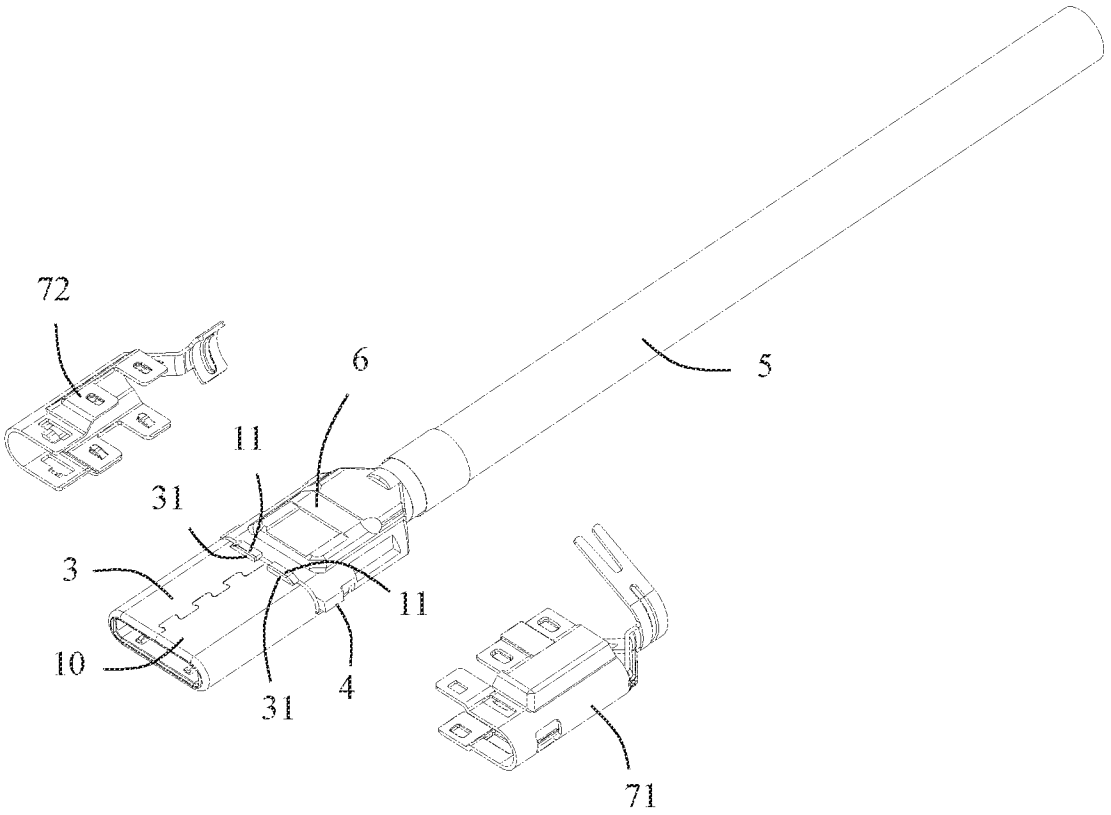
FIG. 9 is a further partial exploded view of FIG. 7 in which a second metal shell is separated.
Figure 10:
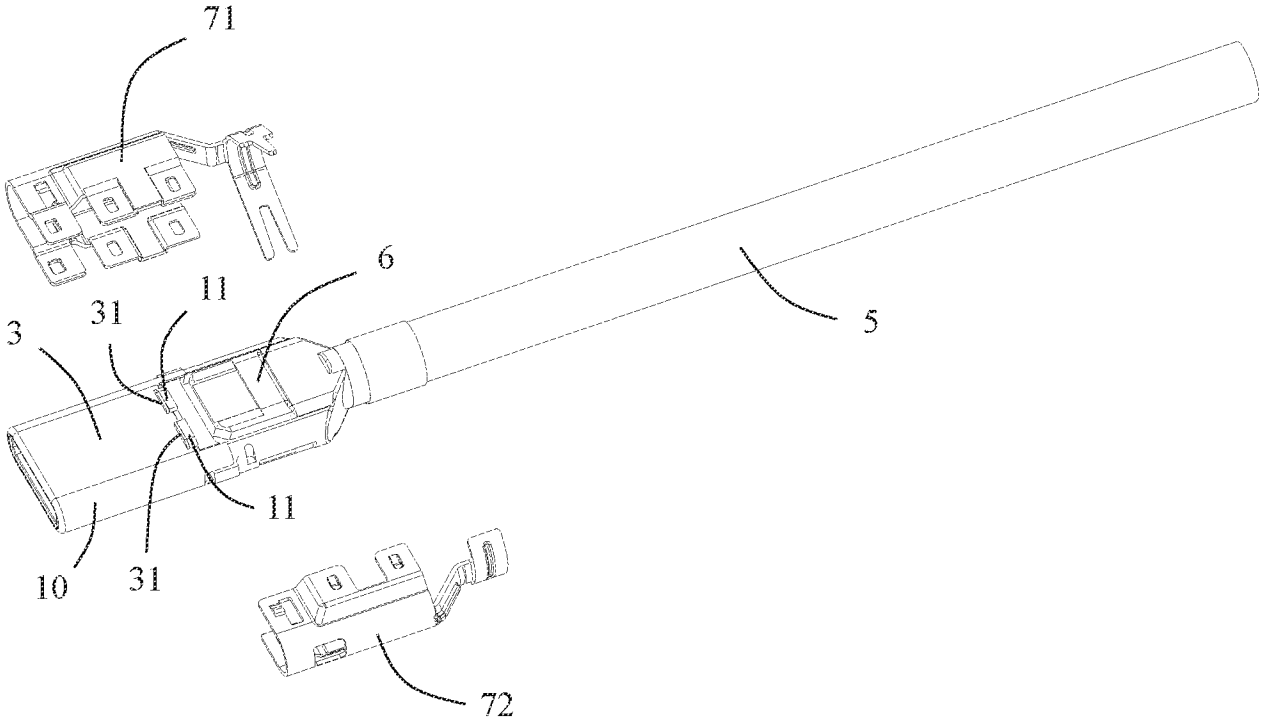
FIG. 10 is a partial perspective exploded view of FIG. 9 from another angle.
Figure 11:
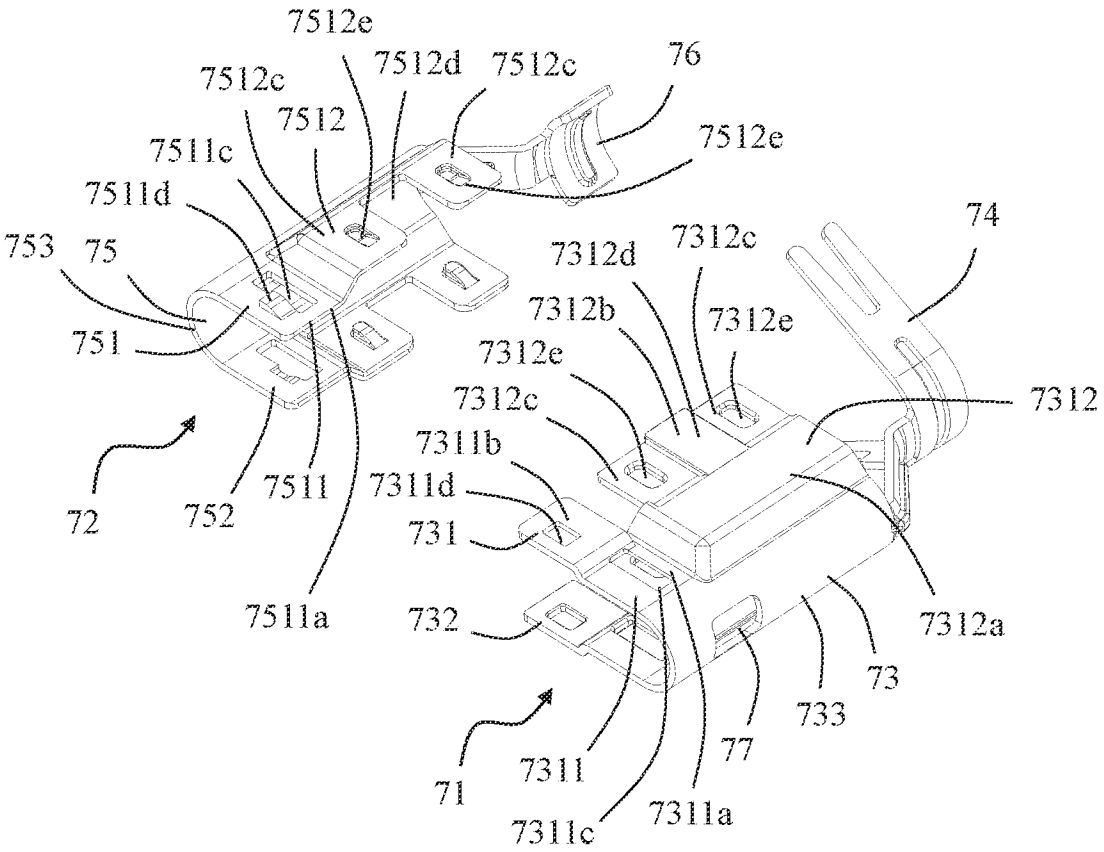
FIG. 11 is a perspective schematic view of the first metal shell and the second metal shell before being assembled with each other.
Figure 12:
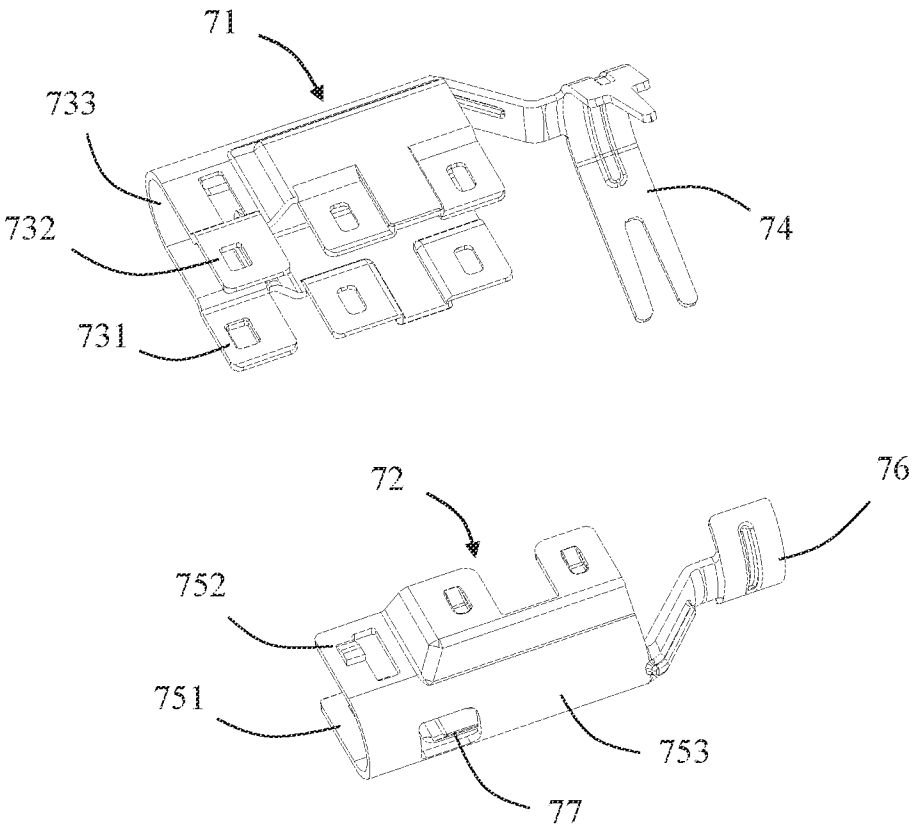
FIG. 12 is a perspective schematic view of FIG. 11 from another angle.

Referring to FIG. 3, in the illustrated embodiment of the present disclosure, the top surface or the bottom surface of the inner metal shell 3 is formed by two parts being buckled with each other. The two parts include a first buckling section 321 and a second buckling section 322. The first buckling section 321 and the second buckling section 322 are buckled with each other through a dovetail groove and a dovetail protrusion, so as to prevent the first buckling section 321 and the second buckling section 322 from being separated from each other.

In the illustrated embodiment of the present disclosure, the insulating body 1 includes a plurality of second protrusions 11 located at a rear end thereof, and protruding upwardly from the first surface 101 and downwardly from the second surface 102. In the illustrated embodiment of the present disclosure, the second protrusions 11 and the insulating body 1 are integrally formed so as to improve the structural strength. In the illustrated embodiment of the present disclosure, two second protrusions 11 are provided protruding upwardly from the first surface 101. The two second protrusions 11 are disposed at intervals along the width direction W-W of the electrical connector 100. Another two second protrusions 11 are provided protruding downwardly from the second surface 102. The another two second protrusions 11 are disposed at intervals along the width direction W-W of the electrical connector 100. In an embodiment of the present disclosure, the two second protrusions 11 located on an upper side and the another two second protrusions 11 located on a lower side are aligned along the height direction H-H of the electrical connector 100, respectively. Besides, the first protrusions 31 and the second protrusions 11 aligned with each other in the front-rear direction abut against each other. The first protrusions 31 and the second protrusions 11 are restricted in the buckle groove along the mating direction M-M. In some embodiments, the first protrusions 31 and the second protrusions 11 which abut against each other so as to form the second engaging portion. In some embodiments, the insulating body 1 may not have the second protrusions 11, and one of the first protrusions 31 alone forms the second engaging portion. In some embodiments, the inner metal shell 3 may not have the first protrusions 31, and one of the second protrusions 11 alone forms the second engaging portion. With this arrangement, when the inner metal shell 3 and the insulating body 1 are assembled, the limit of the inner metal shell 3 and the insulating body 1 can be achieved. In the illustrated embodiment of the present disclosure, cross sections of the second protrusion 11 and the first protrusion 31 are the same. A thickness of the second protrusion 11 in the front-rear direction is greater than a thickness of the first protrusion 31 in the front-rear direction. This arrangement can improve the structural strength of the connector body 10 and reduce the risk of improper separation from the outer metal shell 7 due to wear or a too small mating area.

The conductive terminals 2 are electrically connected to the cable 5 via the built-in circuit board 4. Referring to FIG. 13, in the illustrated embodiment of the present disclosure, the built-in circuit board 4 includes a front end 41, a rear end 42 and a pair of positioning protrusions 43 protruding beyond opposite sides. The front end 41 is provided with a plurality of first soldering pads (gold fingers) 410. The conductive terminals 2 are soldered and fixed to the first soldering pads 410. The front end 41 is also provided with a pair of mounting holes 411. The insulating body 1 is provided with a pair of mounting posts 12 which match with the mounting holes 411. The rear end 42 of the built-in circuit board 4 is provided with a plurality of second soldering pads 421. The conductive cores 51 of the cable 5 are soldered and fixed to the corresponding second soldering pads (gold fingers) 421. In the illustrated embodiment of the present disclosure, the first soldering pads 410 and the second soldering pads 421 are located on opposite sides (for example, an upper surface and a lower surface) of the built-in circuit board 4, respectively, so as to facilitate the arrangement of the gold fingers and reduce the difficulty of soldering. Referring to FIG. 13, the cable 5 also includes an insulating layer 52 wrapped on each conductive core 51, an isolation layer 53 wrapped on the insulating layer 52, a ground shielding layer 54 wrapped on the isolation layer 53, and an outer insulating layer 55 wrapped on the ground shielding layer 54.

In the illustrated embodiment of the present disclosure, the insulating housing 6 is over-molded on a part of the connector body 10, at least a part of the built-in circuit board 4, and a part of the cable 5 so as to improve the structural strength. The first protrusion 31 and the second protrusion 11 are exposed at a front of the insulating housing 6 so as to be locked with the outer metal shell 7. The positioning protrusions 43 of the built-in circuit board 4 protrude beyond opposite sides of the insulating housing 6 so as to be locked with the outer metal shell 7.

In some embodiments, two first buckle portions are provided and disposed on opposite sides of the insulating housing 6, respectively, in the height direction H-H. Two second buckle portions are provided and disposed on opposite sides of the insulating housing 6, respectively, in the height direction H-H. The first buckle portion and the second buckle portion located on one side of the insulating housing 6 are buckled with each other. The first buckle portion and the second buckle portion located on the other side of the insulating housing 6 are buckled with each other. As a result, the outer metal shell 7 at least partially covers the insulating housing 6.

Referring to FIGS. 3 to 12, the outer metal shell 7 at least partially covers the inner metal shell 3. The inner metal shell 3 and the outer metal shell 7 are fixed to each other via the first buckle portion being buckled with the second buckle portion, and via the first engaging portion being engaged with the second engaging portion. The inner metal shell 3 and the outer metal shell 7 are not fixed to each other by soldering or welding. In other words, the inner metal shell 3 and the outer metal shell 7 can be firmly fixed to each other without soldering or welding. In the illustrated embodiment of the present disclosure, the first metal shell 71 and the second metal shell 72 are assembled together along the width direction W-W of the electrical connector 100, so that the outer metal shell 7 partially covers the inner metal shell 3 and partially covers the insulating housing 6. The width direction W-W is perpendicular to the height direction H-H and the mating direction M-M. The first metal shell 71 is provided with the first buckle portion. The second metal shell 72 is provided with the second buckle portion that is buckled with the first buckle portion.

Specifically, in the illustrated embodiment of the present disclosure, the first metal shell 71 includes a substantially U-shaped first main body portion 73 and a first grounding portion 74 extending rearwardly from the first main body portion 73. The second metal shell 72 includes a substantially U-shaped second main body portion 75 and a second grounding portion 76 extending rearwardly from the second main body portion 75. The first grounding portion 74 and/or the second grounding portion 76 are adapted to contact the grounding shielding layer 54 of the cable 5 so as to improve the grounding shielding effect. The first grounding portion 74 and the second grounding portion 76 are wrapped together to clamp the cable 5.

The first body portion 73 includes a first upper wall 731, a first lower wall 732, and a first side wall 733 connecting the first upper wall 731 and the first lower wall 732. The first upper wall 731 and the first lower wall 732 are symmetrically disposed along a horizontal plane which is located between the first upper wall 731 and the first lower wall 732. The description below only takes the first upper wall 731 as an example. The structure of the first lower wall 732 can be referred to the first upper wall 731. The first upper wall 731 includes a first front end portion 7311 and a first rear end portion 7312 located at a rear end of the first front end portion 7311. The first front end portion 7311 includes a first recessed portion 7311*a* and a first raised portion 7311*b* extending laterally from the first recessed portion 7311*a* toward the second metal shell 72. The first raised portion 7311*b* is higher than the first recessed portion 731*a*. The first recessed portion 7311*a* includes a first buckle groove 7311*c* extending through the first recessed portion 7311*a* along a top-bottom direction. The first raised portion 7311*b* defines a buckling hole 7311*d* extending through the first raised portion 7311*b* along the top-bottom direction.

The first rear end portion 7312 includes a first body portion 7312*a* located at a rear end of the first recessed portion 7311*a* and higher than the first recessed portion 7311*a*, and a first extension portion 7312*b* extending laterally toward the first metal shell 71. The first extension portion 7312*b* is located at a rear end of the first raised portion 7311*b* and is spaced from the first raised portion 7311*b* in the front-rear direction. The first extension portion 7312*b* is provided with two first protruding portions 7312*c* spaced apart in the front-rear direction, and a guiding block 7312*d* located between the two first protruding portions 7312*c*. The guiding block 7312*d* is connected between the two first protruding portions 7312*c* in the front-rear direction so as to improve the structural strength. Both the guiding block 7312*d* and the first raised portion 7311*b* are higher than the first protruding portion 7312*c*. Each of the first protruding portions 7312*c* defines a first opening 7312*e*.

The second main body portion 75 includes a second upper wall 751, a second lower wall 752, and a second side wall 753 connecting the second upper wall 751 and the second lower wall 752. The second upper wall 751 and the second lower wall 752 are symmetrically disposed along a horizontal plane which is located between the second upper wall 751 and the second lower wall 752. The description below only takes the second upper wall 751 as an example. The structure of the second lower wall 752 can be referred to the second upper wall 751. The second upper wall 751 includes a second front end 7511 and a second rear end 7512 located at a rear end of the second front end 7511. The second front end portion 7511 and the second rear end portion 7512 are integrally connected in the front-rear direction. The second rear end 7512 is higher than the second front end 7511. The second front end portion 7511 is provided with a second recessed portion 7511*a*. The second recessed portion 7511*a* is provided with a second buckling groove 7511*c* extending through the second recessed portion 7511*a* along the top-bottom direction, and a buckling protrusion 7511*d* for locking with the buckling hole 7311*d*.

The second rear end portion 7512 includes two second protruding portions 7512*c* spaced apart in the front-rear direction, and a guiding slot 7512*d* located between the two second protruding portions 7512*c*. The guiding slot 7512*d* is used for receiving and positioning the guiding block 7312*d*. Of course, in other embodiments, the guiding block 7312*d* and the guiding slot 7512*d* can also be swapped in position. That is, the guiding block 7312*d* is provided on the second rear end portion 7512, and the guiding slot 7512*d* is provided on the first rear end portion 7312. Each second protruding portion 7512*c* is also provided with a first protruding tab 7512*e* formed by stamping. The first protruding tab 7512*e* extends at least partially into the first opening 7312*e* along the height direction H-H.

The first side wall 733 and the second side wall 753 defines positioning openings 77, respectively, for receiving the positioning protrusions 43 of the built-in circuit board 4.

When the first metal shell 71 and the second metal shell 72 are assembled with each other, the guiding block 7312*d* is received and positioned in the guiding slot 7512*d*. The first raised portion 7311*b* abuts against an upper surface of the second recessed portion 7511*a*. The second protruding portion 7512*c* abuts against an upper surface of the first protruding portion 7312*c*. The first raised portion 7311*b* and the second recessed portion 7511*a* at least partially overlap in the height direction H-H. The second protruding portion 7512*c* and the first protruding portion 7312*c* at least partially overlap in the height direction H-H. Thus, the overall strength of the split outer metal shell 7 is strengthened, and its ability to resist deformation is improved.

When the first metal shell 71 and the second metal shell 72 are assembled in place, the buckling protrusion 7511*d* is locked upwardly in the buckling hole 7311*d* so as to prevent the first metal shell 71 and the second metal shell 72 from being separated from each other along the width direction W-W and/or the mating direction M-M. The first protruding tab 7512*e* extends at least partially into the first opening 7312*e* along the height direction H-H, so as to prevent the first metal shell 71 and the second metal shell 72 from being separated from each other along the mating direction M-M and/or the width direction W-W. The outer metal shell 7 at least partially encloses the inner metal shell 3.

An upper concept of the first buckle groove 7311*c* and the second buckle groove 7511*c* is the buckle groove. The buckle groove is adapted to receive the corresponding first protrusion 31 and the second protrusion 11 so that the first protrusion 31 and the second protrusion 11 are restricted in the buckle groove along the mating direction M-M of the electrical connector 100. This design is beneficial for combining the insulating body 1 and the inner metal shell 3 into a compact whole, thereby reducing the risk of improper separation of the insulating body 1 and the inner metal shell 3.

The first buckle portion includes the first raised portion 7311*b* and/or the first extension portion 7312*b*. The second buckle portion includes the second recessed portion 7511*a* and/or the second rear end portion 7512. Through the guiding and positioning of the guiding block 7312*d* and the guiding slot 7512*d*, the buckling protrusion 7511*d* can be accurately locked in the buckling hole 7311*d*, and the first protruding tab 7512*e* can be accurately locked in the first opening 7312*e*. At the same time, the guiding block 7312*d* can greatly reduce the risk of fixing failure due to torsion w % ben the outer metal shell 7 is subjected to an external force.

Compared with the prior art, the inner metal shell 3 and the outer metal shell 7 of the electrical connector 100 of the present disclosure do not have to be fixed by soldering or welding. In the illustrated embodiment of the present disclosure, the inner metal shell 3 and the outer metal shell 7 are connected by a corresponding buckle structure. With this arrangement, a soldering or welding process can be omitted, thereby saving costs. By omitting the soldering or welding process, it eliminates the accumulation of bad difference generated in the soldering or welding process, thereby improving the yield of the product. In addition, the outer metal shell 7 of the electrical connector 100 of the present disclosure is a split type, and includes a first metal shell 71 and a second metal shell 72 assembled with each other.

Compared with the one-piece outer metal shell, it reduces the manufacturing difficulty. By designing the outer metal shell 7 of the electrical connector 100 of the present disclosure having the first metal shell 71 and the second metal shell 72 which are assembled with each other, the automatic assembling and fixing becomes operable, thereby improving the assembling efficiency of the electrical connector 100.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

a connector body, comprising an insulating body, a conductive terminal fixed to the insulating body, and an inner metal shell at least partially covering the insulating body; and an outer metal shell, at least partially covering the inner metal shell;

wherein the outer metal shell comprises a first metal shell and a second metal shell, the first metal shell and the second metal shell are assembled with each other, the first metal shell comprises a first buckle portion, the second metal shell comprises a second buckle portion which is buckled with the first buckle portion;

wherein the first metal shell and/or the second metal shell comprise a first engaging portion, and the connector body comprises a second engaging portion which is engaged with the first engaging portion; and wherein the first buckle portion comprises a first protruding portion, the second buckle portion comprises a second protruding portion, the first protruding portion and the second protruding portion at least partially overlap along a height direction of the electrical connector; and wherein the first protruding portion defines a first opening, the second protruding portion comprises a first protruding tab extending at least partially into the first opening along the height direction.

2. The electrical connector according to claim 1, wherein the second engaging potion comprises a first protrusion provided on the inner metal shell and a second protrusion provided on the insulating body; and wherein the first engaging portion comprises a buckle groove to lock with the first protrusion and the second protrusion.

3. The electrical connector according to claim 2, wherein the first protrusion and the second protrusion abut against each other; and wherein the first protrusion and the second protrusion are restricted in the buckle groove along a mating direction of the electrical connector.

4. The electrical connector according to claim 3, wherein the connector body comprises a first surface and a second surface along a height direction of the electrical connector, the first surface and the second surface are opposite to each other, the height direction is perpendicular to the mating direction; and wherein the number of the second engaging portions is at least two, in which one of the second engaging portions is exposed to the first surface, and another one of the second engaging portions is exposed to the second surface; and wherein the number of the first engaging portions is at least two, in which the two first engaging portions correspond to the first surface and the second surface, respectively.

5. The electrical connector according to claim 4, wherein the number of the second engaging portions is four, in which two of the four second engaging portions are disposed on the first surface, and another two of the four second engaging portions are disposed on the second surface; and wherein the number of the first engaging portions is four, in which two of the four first engaging portions are provided on the first metal shell and correspond to the first surface and the second surface, respectively; and another two of the four first engaging portions are provided on the second metal shell and correspond to the first surface and the second surface, respectively.

6. The electrical connector according to claim 1, wherein the first protruding portion and the second protruding portion extend along a width direction of the electrical connector, respectively; and the first protruding portion and the second protruding portion extend along opposite directions; and wherein the first metal shell and the second metal shell are assembled together along the width direction.

7. The electrical connector according to claim 6, wherein the first metal shell and the second metal shell are provided with a guiding block and a guiding slot mating with each other, and the guiding slot extends along the width direction.

8. The electrical connector according to claim 7, wherein the number of the first protruding portions is at least two and the number of the second protruding portions is at least two, the guiding block is located between two adjacent first protruding portions along the mating direction of the electrical connector, the mating direction is perpendicular to the height direction and the width direction, the guiding slot is located between two adjacent second protruding portions along the mating direction, and the guiding block is positioned in the guiding slot along the width direction.

9. An electrical connector, comprising:

a connector body, comprising an insulating body, a conductive terminal fixed to the insulating body, and an inner metal shell at least partially covering the insulating body; and an outer metal shell, at least partially covering the inner metal shell;

wherein the outer metal shell comprises a first metal shell and a second metal shell, the first metal shell and the second metal shell are assembled with each other, the first metal shell comprises a first buckle portion, the second metal shell comprises a second buckle portion which is buckled with the first buckle portion;

wherein the first metal shell and/or the second metal shell comprise a first engaging portion, and the connector body comprises a second engaging portion which is engaged with the first engaging portion; and wherein the electrical connector further comprises an insulating housing over-molded on a part of the connector body, two first buckle portions are provided and disposed on opposite sides of the insulating housing, respectively, in a height direction of the electrical connector; wherein two second buckle portions are provided and disposed on opposite sides of the insulating housing, respectively, in the height direction.

10. The electrical connector according to claim 1, further comprising a built-in circuit board and a cable, the conductive terminal is electrically connected to the cable via the built-in circuit board; wherein the built-in circuit board comprises a positioning protrusion, and the outer metal shell defines a positioning opening to receive the positioning protrusion.

11. The electrical connector according to claim 1, wherein the inner metal shell and the outer metal shell are fixed to each other via the first buckle portion being buckled with the second buckle portion and via the first engaging portion being engaged with the second engaging portion; and wherein the inner metal shell and the outer metal shell are fixed to each other without soldering or welding.

12. An electrical connector, comprising:

a connector body, comprising an insulating body, a plurality of conductive terminals fixed to the insulating body, and an inner metal shell at least partially enclosing the insulating body along a mating direction of the electrical connector;

a cable, wherein the conductive terminals are electrically connected to the cable; and an outer metal shell, at least partially enclosing the inner metal shell;

wherein the outer metal shell comprises a first metal shell and a second metal shell, the first metal shell and the second metal shell are assembled with each other along a width direction of the electrical connector perpendicular to the mating direction of the electrical connector, the first metal shell comprises a first buckle portion, the second metal shell comprises a second buckle portion which is locked with the first buckle portion;

wherein the first metal shell and/or the second metal shell comprise a first engaging portion, and the connector body comprises a second engaging portion which is engaged with the first engaging portion; and wherein the second engaging potion comprises a first protrusion provided on the inner metal shell and a second protrusion provided on the insulating body; wherein the first engaging portion comprises a buckle groove to lock with the first protrusion and the second protrusion; wherein the first protrusion and the second protrusion abut against each other; and wherein the first protrusion and the second protrusion are restricted in the buckle groove along the mating direction of the electrical connector.

13. The electrical connector according to claim 12, wherein the connector body comprises a first surface and a second surface along a height direction of the electrical connector, the first surface and the second surface are opposite to each other, the height direction is perpendicular to the mating direction; wherein the number of the second engaging portions is four, in which two of the four second engaging portions are disposed on the first surface, and another two of the four second engaging portions are disposed on the second surface; and wherein the number of the first engaging portions is four, in which two of the four first engaging portions are provided on the first metal shell and correspond to the first surface and the second surface, respectively; and another two of the four first engaging portions are provided on the second metal shell and correspond to the first surface and the second surface, respectively.

14. The electrical connector according to claim 12, wherein the first buckle portion comprises a first protruding portion, the second buckle portion comprises a second protruding portion, the first protruding portion and the second protruding portion at least partially overlap along a height direction of the electrical connector; and wherein the first protruding portion defines a first opening, the second protruding portion comprises a first protruding tab extending at least partially into the first opening along the height direction.

15. The electrical connector according to claim 14, wherein the first protruding portion and the second protruding portion extend along the width direction of the electrical connector, respectively; and the first protruding portion and the second protruding portion extend along opposite directions; and wherein the first metal shell and the second metal shell are assembled together along the width direction.

16. The electrical connector according to claim 15, wherein the first metal shell and the second metal shell are provided with a guiding block and a guiding slot mating with each other, and the guiding slot extends along the width direction; wherein the number of the first protruding portions is at least two and the number of the second protruding portions is at least two, the guiding block is located between two adjacent first protruding portions along the mating direction of the electrical connector, the mating direction is perpendicular to the height direction and the width direction, the guiding slot is located between two adjacent second protruding portions along the mating direction, and the guiding block is positioned in the guiding slot along the width direction.

17. The electrical connector according to claim 12, further comprising a built-in circuit board through which the conductive terminals are electrically connected to the cable.

18. The electrical connector according to claim 12, wherein the inner metal shell and the outer metal shell are fixed to each other via the first buckle portion being buckled with the second buckle portion and via the first engaging portion being engaged with the second engaging portion; and wherein the inner metal shell and the outer metal shell are fixed to each other without soldering or welding.

* * * * *